United States Patent [19]

Cope et al.

[11] 3,982,813

[45] Sept. 28, 1976

[54] WEATHER SEALED LAMP SOCKET ASSEMBLY

[75] Inventors: Kenneth P. Cope, Warren; Robert G. Plyler, Vienna, both of Ohio

[73] Assignee: General Motors Corporation, Detroit, Mich.

[22] Filed: Nov. 19, 1975

[21] Appl. No.: 633,424

[52] U.S. Cl. ..... 339/127 R; 339/113 R; 339/206 L

[51] Int. Cl.[2] ..... H01R 13/52; H01R 13/54

[58] Field of Search..... 339/88 R, 91 L, 119 L, 339/125 L, 127 R, 113 R, 91 R, 94 L, 176 L, 184 L, 188 R, 206 L, 278 L

[56] References Cited

UNITED STATES PATENTS

| | | | |
|---|---|---|---|
| 3,626,359 | 12/1971 | DeLano | 339/127 R |
| 3,718,892 | 2/1973 | Burgess et al. | 339/88 R X |
| 3,894,205 | 7/1975 | List et al. | 339/127 R X |

*Primary Examiner*—Roy Lake
*Assistant Examiner*—E. F. Desmond
*Attorney, Agent, or Firm*—J. C. Evans

[57] ABSTRACT

A socket and panel mounting assembly for connecting a lamp in a lamp housing that has a rear panel exposed to all weather conditions includes a socket mounting hole with a weather guard ring formed therearound and including a notch thereon engageable with a flexible socket lock arm that audibly indicates when the socket is in place on the panel and wherein a flexible gasket is supported on the mounted end of the socket to take up the interference between the lamp socket and the mounting hole panel thickness for further sealing the mounting hole within the ring. The hole and socket having coaxial means thereon to permit axial insertion of the socket into the mounting hole to compress the gasket and to locate the socket lock arm for engagement with the notch when the socket is moved to a locked, rotated index position on the panel. In one embodiment terminal connections to the socket are provided axially therefrom and in another embodiment terminal connections are located at right angles to the bulb access to produce a low profile configuration wherein the feed terminals are in the form of cantilever springs positioned perpendicular to the bulb centerline and located within a sealed housing having a cover secured thereto with a compressible pad of gasket material to seal the terminals at the exposed periphery of the cover to the integral socket terminal housing.

3 Claims, 10 Drawing Figures

WEATHER SEALED LAMP SOCKET ASSEMBLY

This invention relates to lamp housing assemblies and more particularly to panel and socket mounting assemblies wherein a bulb is removably supported on a lamp housing in sealed relationship therewith.

Lamp housings used on vehicles in many cases are located interiorly of the exterior sheet metal of the vehicle, in which case, a socket and mounting panel assembly can be utilized wherein the socket is interconnected to the panel without requirement for sealing between the connecting interfaces thereof. However, in some cases it is desirable to locate a lamp housing of a vehicle exteriorly of the outer sheet metal so that the socket mounting panel portion of the lamp housing is exposed to all weather conditions. Furthermore, in such cases the socket mounting panel of the lamp housing may be located in relatively inaccessible positions, and yet still be exposed to dirt, moisture and the like thus requiring a socket to mounting panel interface that is positively sealed against ambient conditions.

An object of the present invention is to provide an improved panel mounting and socket assembly for association with lamp housings exposed to all weather conditions and with a socket mounting hole located in relatively inaccessible positions by the provision of a panel with socket mounting hole having a watershed ring in surrounding relationship thereto and also including a socket lock arm catch or notch thereon associated with a socket having retention ears on one end thereof indexed with respect to the mounting hole for axially locating the socket within the watershed ring and wherein a lock arm on the socket is movable with respect to and flexed across the notch on the watershed ring to produce an audible indication that the socket assembly has been secured in a rotated indexed position on the mounting panel and axially inwardly of the watershed ring so as to locate a compressible gasket on the end of the socket in a compressed relationship between the mounting panel and the socket to positively seal the socket mounting hole axially inwardly of the watershed ring.

Still another object of the present invention is to improve socket and panel mounting assemblies by the provision of an improved socket mounting hole panel configuration including a watershed ring thereon having a portion thereof defining a catch surface for a releasable lock arm on a socket and wherein the mounting hole and socket include coacting means thereon for retaining the bulb support end of the socket axially inwardly of the watershed ring and to locate a compressible gasket thereon in sealed relationship with the socket mounting hole as well as to locate the lock arm with respect to the catch surface for movement thereacross to produce an audible indication of positioning of the socket on the mounting panel in a properly sealed and protected indexed relationship within the mounting ring and wherein the lock arm on the socket includes a portion thereon for releasably moving the lock arm out of engagement with the catch surface for removing the socket from the panels.

Still another object of the present invention is to provide a combination panel and socket assembly of the type set forth in the preceding object wherein the socket lock arm is disposed parallel to the bulb axis and is movable axially inwardly of the watershed ring as the socket is axially inserted onto the mounting panel and where rotation of the socket into a preselected indexed position with respect to the mounting panel of a lamp housing causes the lock arm to move across a notched portion on the watershed ring to a locked, indexed position indicated by an audible click of the lock arm so that the socket can be mounted in a blind application from the rear of a mounting panel with an assurance that it is properly positioned thereon to locate bulb filaments in a desired optical relationship with lamp housing components.

Yet another object of the present invention is to improve lamp assemblies having a rear socket mounting panel exposed to all weather conditions and locatable in a blind, inaccessible position by the provision of a socket mounting hole and a socket having coacting means for guiding the socket with respect to the panel in a blind application and wherein the panel includes a weather guard ring thereon in surrounding relationship to the mounting hole and wherein the socket and weather guard ring include coacting means for producing a positive indexed relationship between the socket and mounting panel along with an audible indication of proper positioning of the socket on the panel.

Still another object of the present invention is to provide an improved panel and socket mounting assembly of the type in the preceding object wherein the socket includes a terminal housing formed generally perpendicularly to the bulb centerline and including cantilever spring feed terminals positioned perpendicularly to the bulb centerline in close spaced parallellism to the rear face of the mounting panel to limit the axial extent of the socket assembly outboard of the lamp housing and wherein the terminal housing is sealed by a cover that maintains a gasket pad in sealed relationship with the periphery of the socket housing to seal one end of the socket and wherein the opposite end thereof is sealed by a compressible gasket located axially inwardly of the weather guard ring and compressed to compensate for interference between the fastened location of the socket on the mounting panel and the thickness of the mounting panel following movement of the socket into an interlocked relationship between its lock arm and the lock arm notch of the weather guard ring.

Further objects and advantages of the present invention will be apparent from the following description, reference being had to the accompanying drawings wherein a preferred embodiment of the present invention is clearly shown.

Figure 1:
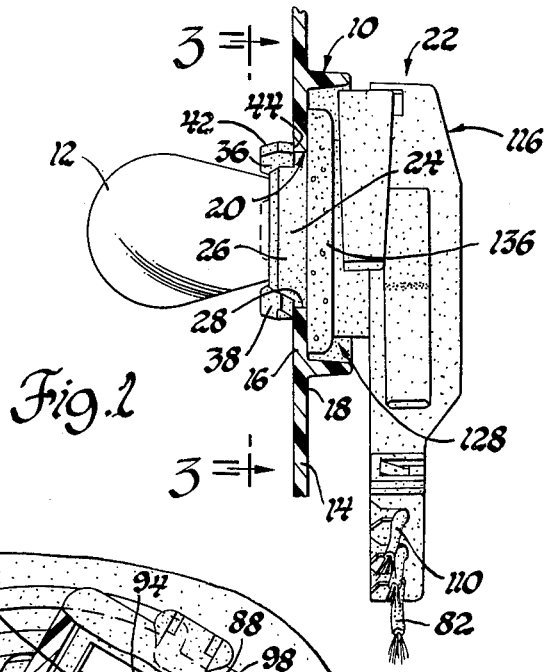
FIG. 1 is a side elevational view of a panel and socket mounting assembly of the present invention showing a fragmentary portion of the mounting panel in cross section.

In the drawings, FIG. 1 illustrates a socket and panel mounting assembly 10 for locating an electrically energizable bulb 12 in a desired axial and rotational position with respect to optical components of a lamp housing. The assembly 10 is suitable for use in motor vehicle applications and is especially configured for use in automotive applications wherein a rear panel for mounting a socket is located in an exposed position to be subject to all weather conditions thereby requiring an effective seal between a removable socket component of the assembly 10 and the mounting panel itself.

A rear panel 14 of a lamp housing is illustrated in fragmentary form. It includes an inside surface 16 that is protected from ambient conditions surrounding the lamp housing. However, it further includes a rear surface 18 that is exposed to all weather conditions and is often located in close adjacent relationship with other support members so as to make it difficult to locate a socket for insertion through a socket mounting opening 20 through the panel 14. Such lamp housings and socket assemblies are used as side markers on vehicles, combination stop and tail light housings for use on the rear of a vehicle and running light lamp housings all of which may desirably be located exteriorly of the vehicle body sheet metal.

Figure 2:
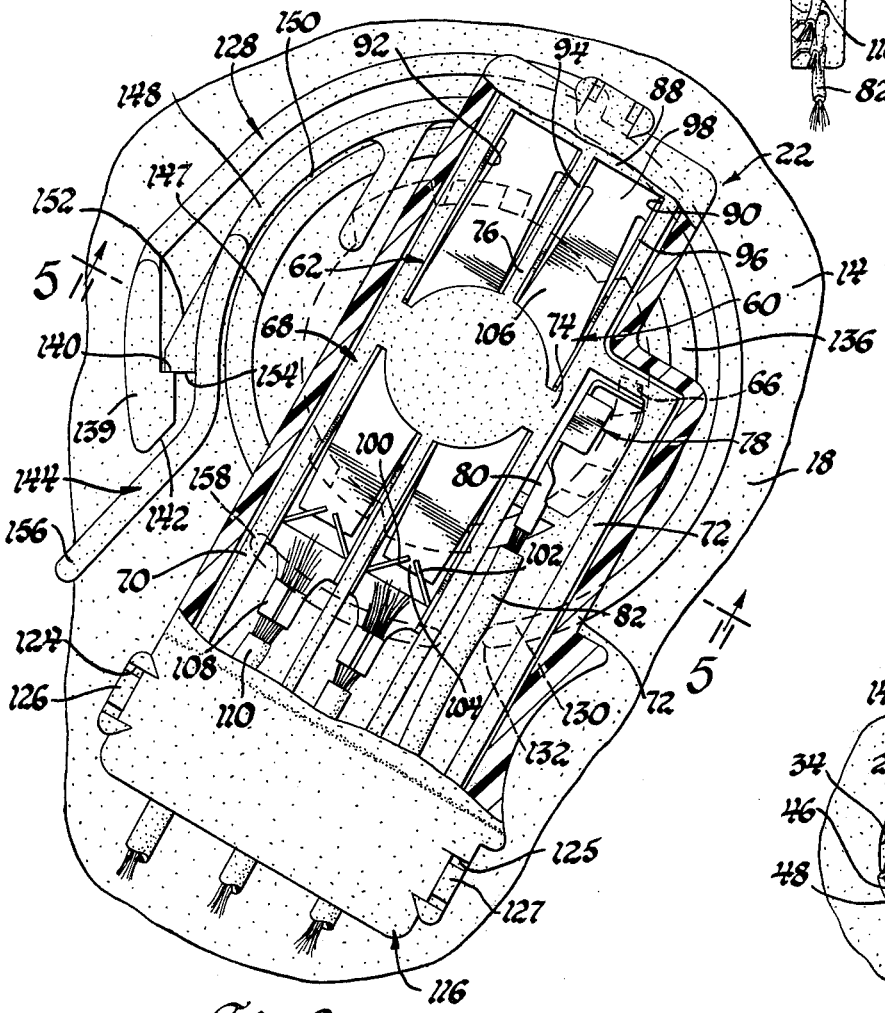
FIG. 2 is an enlarged, fragmentary end elevational view of the socket and mounting panel assembly of the present invention with an end cover portion thereof partially broken away.
Figure 3:
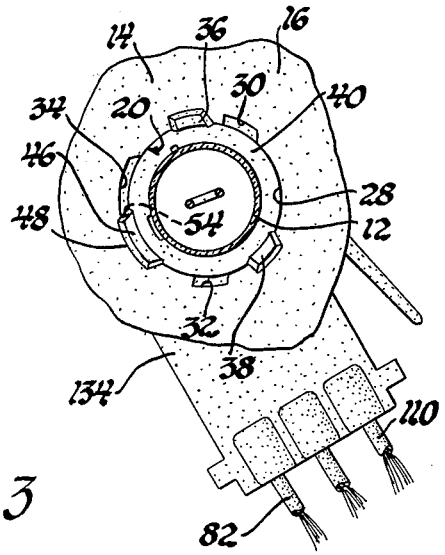
FIG. 3 is an end elevational view taken along line 3—3 of FIG. 1.
Figure 4:
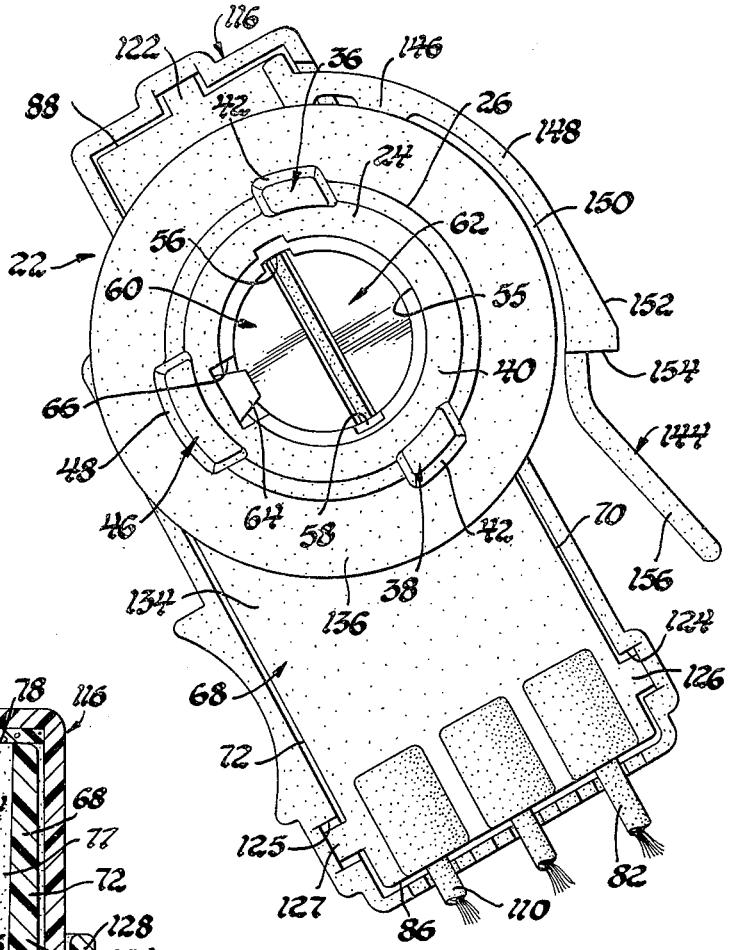
FIG. 4 is an enlarged end elevational view of the socket in FIG. 1, removed from the panel.
Figure 6:
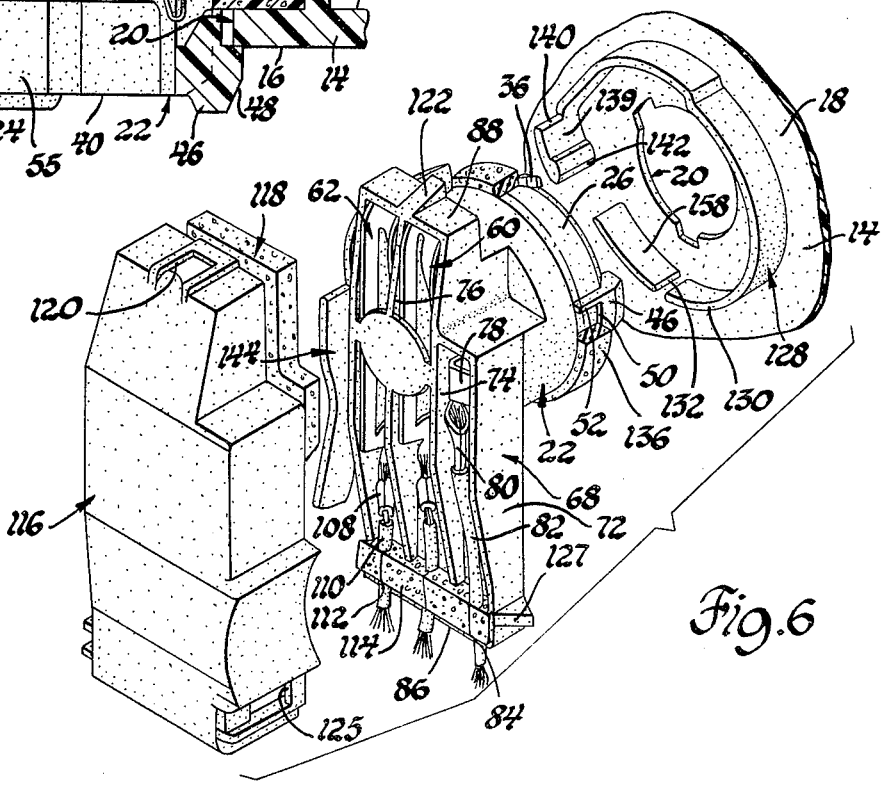
FIG. 6 is an exploded view in perspective of the component parts of the present invention.

For example, with reference to the embodiment in FIGS. 1 through 3, the panel 14 may form the rear wall of a sealed stop light lamp housing in which the bulb 14 must be accurately positioned with respect to a reflex lens for directing light from within the housing when the vehicle brakes are applied. Typically, the rear surface 18 in a rear mounted lamp assembly will be located in close spaced relationship to a vehicle body component. Accordingly, the assembly 10 includes a socket 22 having a generally tubular bulb end portion 24 having a circular outer peripheral wall 26 that is of slightly less diameter than a central circular opening 28 in the socket mounting hole 20. The socket mounting hole 20, which is best illustrated in FIGS. 3 and 6, further includes a pair of oppositely spaced, radially outwardly directed clearance slots 30, 32 located in line along a chord across the circular opening 28. The mounting hole 20 further includes a third indexing and clearance slot 34 of greater arcuate extent than the slots 30, 32 each of which have the same arcuate extent. The slots 30, 32, 34 as configured, define an indexed array so that the socket will fit only one way axially through the mounting hole.

The socket end portion 24 includes a pair of retention ears 36, 38 extending axially beyond an inboard end surface 40 on the end portion 24. Each of the ears 36, 38 has a generally trapezoidally configured front elevational appearance and a lead taper 42 thereon which facilitates fit of the socket 22 into the socket mounting hole 20. The lead taper 42 thereon engages the clearance slots 30, 32 at the perimeter of the mounting hole 28 so that the socket 22 will be easily aligned for axial insertion to a point where the rear wall 44 on each of the retention ears 36, 38 will be located axially inwardly of the inner surface 16 prior to a final assembly torque application to be described.

In addition to the ears 36, 38 the socket portion 24 includes an indexing and retention ear 46 having a tapered lead surface 48 thereon that axially guides the socket portion 24 through slot 34 into the mounting hole 20 and to locate a rear surface 50 thereon as shown in FIG. 6 axially inboard of the surface 16. The retention ear 46 further includes an axially directed rib 52 thereon which will contact an edge 54 of the slot 34 when the socket 22 is rotated to a fixed rotatably indexed position on the panel 14.

The end portion 24 includes a generally circular bulb base opening 55 therein with a pair of diametrically located bulb base pin guide slots 56, 58 on either side thereof to locate bulb contacts with respect to a pair of cantilever spring feed terminals 60, 62 and a ground spring contact 64 that is supportingly received in the housing portion 24 at an internal slot 66 therein.

One feature of the present invention is that the housing portion 24 has a reduced axial extent and the main portion of the socket 22 is in the form of a generally rectangular integrally formed rearward terminal housing 68 which extends in close spaced parallellism to the outer surface 18 of the mounting panel 14 when the socket 22 is in place. The housing 68 includes a pair of parallel outer walls 70, 72 and a pair of intermediate longitudinally directed divider walls 74, 76. The side wall 72 and divider wall 74 define a ground terminal cavity 77 which is intersected by the slot 66 at one end thereof to receive the spring contact end 64 of a ground terminal 78. A wire connector ring 80 located within the cavity 77 is connected to and extends generally perpendicularly of the contact 64. It, in turn, is electrically connected to a ground wire 82 that extends through a slot 84 in an end wall 86 joined to the side wall 70, 72 for closing one end of housing 68. The opposite end of the housing 68 is closed by an end wall 88.

The feed terminals 60, 62 are located in a pair of spaced, parallel cavities 90, 92 of elongated rectangular configuration formed between the side wall 70 and wall 76; and walls 74, 76, respectively. The terminal 60 is located in the cavity 92 and terminal 62 in cavity 90. Each terminal 60, 62 includes a pair of side rails 94, 96 joined at one end thereof by a bight portion 98. The opposite end of the rails 94, 96 are inwardly struck at 100, 102 to form a stop for a free end 104 of a bowed spring segment 106 extending from the free end 104 back to the bight portion 98 and being bent in a direction to cause the segment 106 to face axially inwardly of the bulb opening 54 so as to define a spring biased electrical contact between the terminals 60, 62 and bulb contacts.

Each of the terminals 60, 62 includes an integrally formed split connector ring 108 at the struck ends of the side rails 92, 94 which is connected to a feed wire 110 directed through an end wall slot 112. The divider walls 74, 76 terminate short of the end wall 86 and a generally rectangularly configured seal gasket 114 is supported interiorly of the housing 68 as best seen in FIG. 6 to tightly grip the outer diameter of each of the wires 82, 110 to positively seal the housing 68 where the wires extend therefrom.

Each of the cavities within the housing 68 is open for easy assembly of each of the terminals into the housing 68. In order to completely seal the interior of the socket 22 the housing 68 has a cover 116 and a compressible seal pad 118 of a planar extent which is congruent to the outside dimensions of the side walls 70, 72 and end walls 86, 88 to completely cover each of the cavities formed in the housing 68. Pad 118 is pressed into sealing engagement with the exterior walls of the housing 68 at the exposed edge thereof by means of the cover 116. Cover 116 includes a retention hole 120 on one end thereof which interlockingly connects to a lock tab 122 on the exterior of the end wall 88. The cover 116 further includes a pair of side lock slots 124, 125 thereon that receive a pair of side lock tabs 126, 127 on the end of the housing portion 68 opposite to the lock tab 122. The lock tabs engage the cover and pull it toward the side and end walls of the housing 68 to press the seal pad 118 into tight sealing engagement with all exposed portions of the housing 68 and along with the gasket 114 will positively seal the exterior joint of the socket 22.

The low profile perpendicular relationship of housing 68 to the short stub socket portion 24 is accomplished by the design of cantilevered spring contact feed terminals 60, 62 which enables terminals to be positioned perpendicular to the bulb centerline while maintaining a good electrical contact at the base of the bulb mounting hole 54 within the socket. The spring segments 106 of each of the feed terminals have necessary spring working range and a reduced solid height so that desired electrical contact within the socket can be obtained within the confines of a low profile housing configuration. The aforedescribed arrangement positively seals the interior of the socket 22 from one end thereof.

Another feature of the present invention is the provision of a water guard or water shed ring 128 formed integrally of the mounting panel 14 and extending rearwardly of the exposed rear surface 18 thereof. The ring 128 extends substantially completely circumferentially around the socket mounting hole 20 and includes a lower segment 130 thereon with a weep opening 132 to drain any condensation from within the ring 128. The ring has an axial extent which encloses socket 22 to a point closely adjacent the inside wall 134 of the housing 68. Additionally, it encloses a compressible, annular gasket 136 supported on the outer peripheral wall 26 of the housing portion 24. The gasket 136 has a thickness to produce an interference fit between the panel 14 and an intermediate peripherally located axially forward flange 138 on the socket 22 between the portion 24 and the housing 68 as best shown in FIG. 5.

When the gasket 136 is compressed between the annular flange 138 and the rear wall 18 the rear walls 44 and 50 of the retention ears will be located axially inwardly of the mounting panel 14. From this position the compact, low-profile socket 22 can be rotated to a locked position where the index rib 52 engages the index edge 54 at which point the filaments of the bulb 12 will be properly positioned with respect to optical components of the unit.

Figure 5:
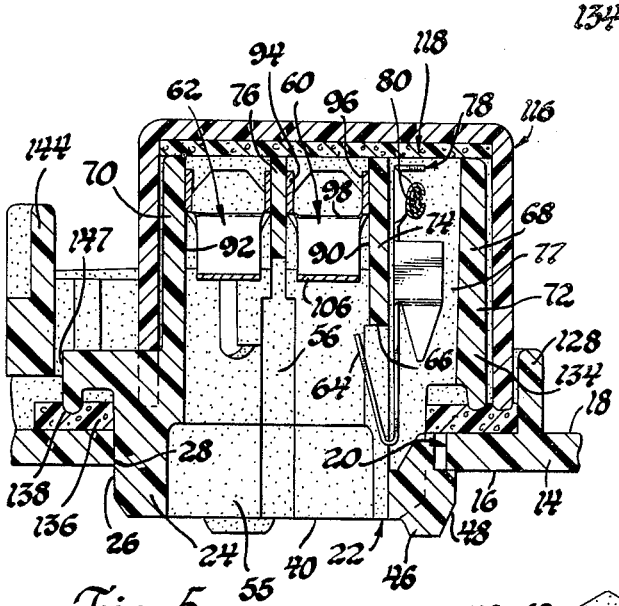
FIG. 5 is a cross sectional view taken along the the line 5—5 of FIG. 2.

Rotation of the socket 22 will cause each of the retention ears 36, 38, 46 to pull the compressible gasket 136 into a tight sealed relationship with the socket hole and the weather guard or water shed ring 128 covers the compressed gasket 136 as is best seen in FIG. 5 to further assure that the interface between the socket 22 and the lamp housing of which the mounting panel 14 defines the rear wall thereof will be positively sealed. Hence, the assembled combination of panel and socket is weather sealed at all ends thereof.

Another feature of the present invention is that one end 139 of the weather guard ring 128 includes a notch 140 thereon and a lead ramp 142 that cooperates with a socket latch or lock arm 144 having a root portion 146 integrally formed on the outer periphery 147 of the intermediate flange 138. The lock arm 144 is cantilevered from the root 146 and includes a curvilinear segment 148 located in close but spaced relationship to the outer periphery 147 by a space 150. Following a sweep of approximately 90° of the outer periphery 147 the lock arm 144 is enlarged radially outwardly to form a lead ramp 152 to a radially inwardly directed catch surface 154. The lock arm 144 has a handle 156 that extends through a space between the end 139 of the ring 128 and a second end segment 158 of ring 128. When the socket 22 is rotated to a locked indexed position as described above, the ramp 152 will pass across the ramp 142 to cause the lock arm 144 to flex inwardly toward the periphery 147 until the socket 22 reaches a desired indexed position at which point the catch surface 154 will snap into the notch 140. This produces an audible indication of proper insertion and positioning of the socket 22 on the mounting panel 14. Since the socket 22 is often mounted on a relatively inaccessible mounting panel 14 from the rear surface thereof this audible indication is proof of positive location of the socket in place on the exteriorly mounted lamp housing without requiring a visual observation of relative positioning of component parts of the panel and socket mounting assembly. Additionally, the handle 156 on the lock arm 144 permits the socket 22 to be readily released from the ring 128 so as to allow the socket housing 22 to be rotated to a point where the retention ears 36, 38 and 46 can be axially removed from the panel 14.

The lock arm and weather guard ring arrangement enables a socket to be connected in a locked and sealed relationship to a mounting panel. Removal of the socket cannot be inadvertent since a positive action must be applied on release handle 156 before the socket can be moved from its locked, sealed relationship on the panel. When the assembled unit is in place, the cover 116 and the compressible seal pad 118 are configured to have a planar extent which covers a good portion of the weather guard ring 128. The cover 116 and gasket 118 have substantial resistance to impact of foreign material against the socket 22 to protect the electrical leads therein. Moreover, the resultant low profile configuration of the mounting assembly 22 minimizes moments on the mounting hole and socket interface caused by application of either mounting or removal forces on the socket housing 22.

While the embodiment in FIGS. 1 through 6 is a preferred embodiment, a second embodimwent is illustrated in FIGS. 7 through 10 and includes a sealed socket and mounting assembly 160 representing a second embodiment of the invention. In this embodiment, a mounting panel 162 is illustrated corresponding to the mounting panel 14 in the first embodiment. This mounting panel includes a socket mounting hole 164 having a pair of radially outwardly directed clearance slots 168, 170 thereon and a third socket clearance slot 172. Additionally, the hole includes an index slot 174 between the slots 170, 172. A central circular opening 176 receives a generally circular outer periphery 178 on an end portion 180 of a socket 182. The housing portion 180 has a bulb base opening 184 therein closed at one end by an end wall 186 in which are supportedly located spring feed terminal contacts 188, 190. Additionally, the socket includes a side slot 192 intersecting the bulb base opening 184 from which a spring contact 194 of a ground terminal extends exteriorly of the opening 184 with the contacts 188, 190 and spring arm 194 completing an electrical circuit across contacts on a bulb base inserted into diametrically located guide slots 196, 197 of the bulb base opening 184.

As in the case of the first embodiment, the end portion 180 includes a pair of retention ears 198, 200 that are guided with respect to the slots 168, 170. The portion 180 further includes a third retention ear 202 having a slightly greater arcuate extent than the ears 198, 200. A rib 204 is located on the portion 180 to engage the slot 174 when the socket 182 is axially inserted through the socket mounting opening 164.

In this embodiment the mounting panel 162 has an inside surface 206 thereon which receives the back edges of each of the retention ears when the socket 182 is in place on the panel 162. It further includes an exterior surface 208 exposed to outside weather conditions.

Figure 7:
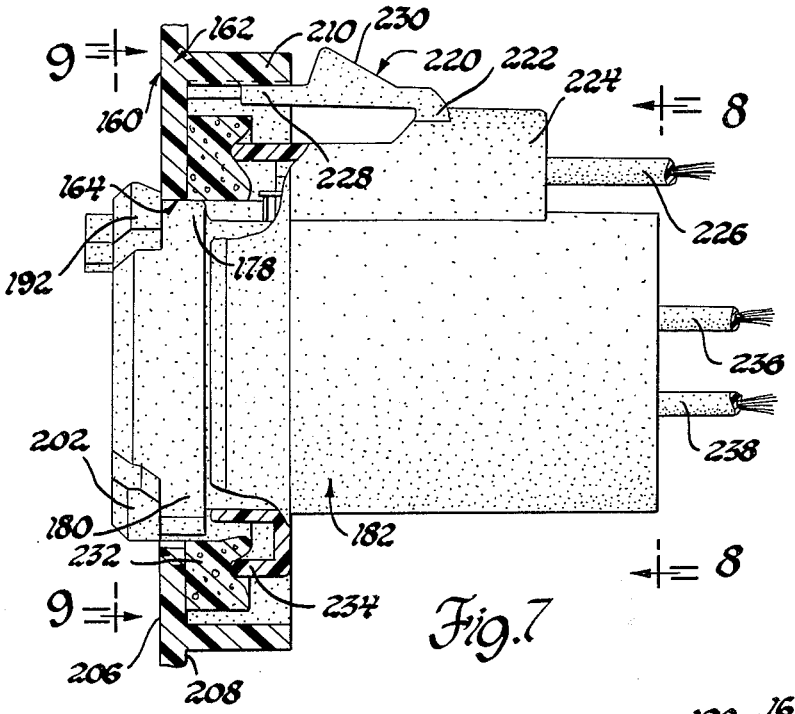
FIG. 7 is a side elevational view partially broken away and sectioned of a second embodiment of the present invention.
Figure 8:
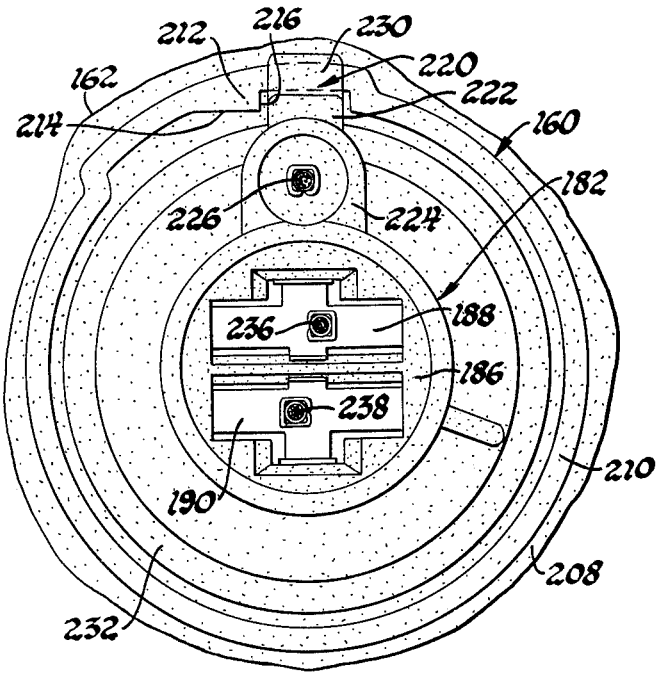
FIG. 8 is an end elevational view of the assembly in FIG. 7 looking in the direction of the arrows 8—8 in FIG. 7.
Figure 9:
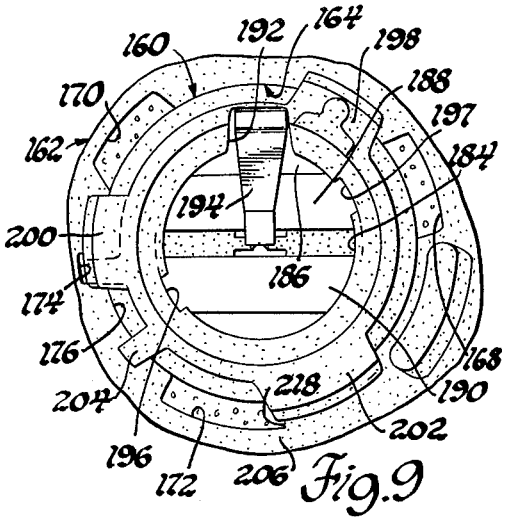
FIG. 9 is an end elevational view of the assembly of FIG. 7 looking in the direction of the arrows 9—9 in FIG. 7.
Figure 10:
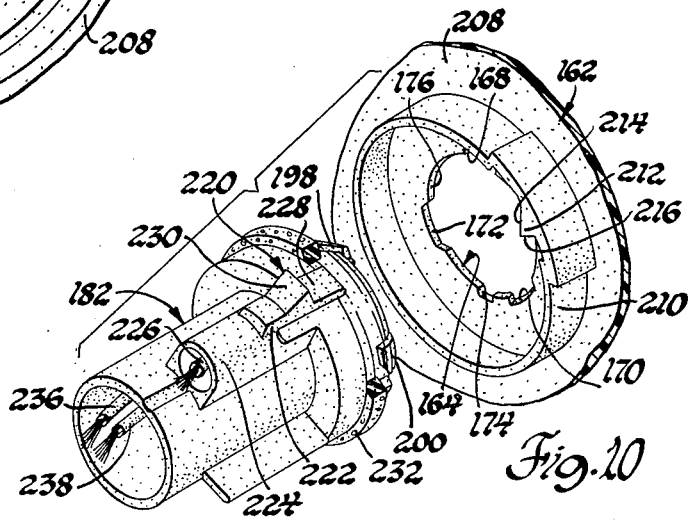
FIG. 10 is an exploded perspective view of the embodiment of FIGS. 7 through 9.

In this embodiment a weather guard or water shed ring 210 extends axially rearwardly of the surface 208 in surrounding relationship to the bulb socket mounting hole 164. The ring 210 includes a radially inwardly directed formation 212 thereon including a ramp surface 214 and a notch 216. Following indexed axial insertion of the housing 182 onto the panel 162 subsequent rotation thereof will move the retention ears into the position shown in FIG. 9 at which point the index rib on the retention ear 202 will be in engagement with an index edge 218 of the slot 172. As the socket 182 is rotated to a desired locked, indexed position on the panel 162 a lock arm 220 formed integrally of the socket housing 182 will produce an audible click movement across the ramp 214 as it enters the notch 216. The arm 220 more particularly includes a root segment 222 secured on the outer surface of a side protuberance 224 extending axially of the socket 182. The protuberance encloses ground terminal wire 226 that connects to the spring contact 194. The lock arm 220 includes an axially extending generally rectangular configured finger 228 that is located axially inwardly of the ring 210 when the socket is in place on the panel. Prior to rotation to a locked position the finger 228 is positioned at a point circumferentially spaced from the ramp 214. As the socket is rotated to a locked position the finger 228 will be depressed radially inwardly toward the socket 182 and then snapped into the notch 216 to produce the audible indication of the socket 182 assuming a locked position on the panel 162. The cantilevered extension formed by the finger 228 also includes a radially outwardly directed release portion 230 which is located radially outwardly of the ring 210 as best shown in FIG. 7 when the socket 182 is locked on the panel 162. When a positive radially inwardly directed force is applied on the release portion 230 the finger 228 will be forced radially inwardly of the notch so that the socket 182 can be rotated to its axially aligned release position.

As in the first embodiment, the socket portion 180 carries an annular compressible sealed gasket 232 which is located completely within the ring 210 to be shielded thereby and is compressed to seal the interface between the socket 182 and the socket mounting hole 164 when the socket 182 is in its locked position. More particularly, it is compressed between the surface 208 and a continuously forward facing intermediate flange 234 formed on the socket 182 rearwardly of the portion 180 thereof. Leads 236, 238 define feed wires to each of the terminals 188, 190 and they extend to a rear opening in the socket 182 which can be sealed by suitable means such as a boot to prevent entrance of a foreign matter, moisture and the like. This, along with the compressed seal gasket 232 and the weather guard ring 210 produces the desired sealed socket and panel mounting assembly of the present invention.

While the embodiments of the present invention, as herein disclosed, constitute a preferred form, it is to be understood that other forms might be adopted.

The embodiments of the invention in which an exclusive property or privilege is claimed are defined as follows.

1. A lamp socket and panel assembly for sealing a lamp housing having a panel exposed to ambient weather conditions comprising: a rear panel with inner and outer surfaces thereon including a lamp socket access opening therethrough having radially outwardly directed slots formed circumferentially therearound, a deflector ring on said rear panel outer surface formed circumferentially around said opening to shield said opening against water flow across the outer surface, a lamp socket including retention ears thereon at circumferential points therearound axially insertable through said ring and slots and rotatable with respect to said panel to secure said socket thereon, said ring having a catch thereon with a lead ramp and notch at a point circumferentially spaced from said retention slots, said socket having a flexible manually releasable lock arm thereon positioned in axial alignment with said ring when the socket is in place and having a surface thereon that rides circumferentially across said lead ramp upon rotation of said socket within said opening, said lock arm being spring biased into said notch to produce an audible signal to indicate positioning of said socket in a rotatably locked position on said panel.

2. A lamp socket and panel assembly for sealing a lamp housing having a panel exposed to ambient weather conditions comprising: a rear panel with inner and outer surfaces thereon including a lamp socket access opening therethrough having radially outwardly directed slots formed circumferentially therearound, a deflector ring on said rear panel outer surface formed circumferentially around said opening to shield said opening against water flow across the outer surface, a lamp socket including retention ears thereon at circumferential points therearound axially insertable through said ring and slots and rotatable with respect to said panel to secure said socket thereon, said ring having a catch thereon with a lead ramp and notch at a point circumferentially spaced from said retention slots, said socket having a flexible manually releasable lock arm thereon positioned in axial alignment with said ring when the socket is in place and having a surface thereon that rides circumferentially across said lead ramp upon rotation of said socket within said opening, said lock arm being spring biased into said notch to produce an audible signal to indicate positioning of said socket in a rotatably locked position on said panel and means on said arm for manually releasing said arm from said latch detent to permit reverse rotation of the socket from the panel to axially align said ears with said slots for axial removal therefrom.

3. A lamp socket and panel assembly for sealing a lamp housing having a panel exposed to ambient weather conditions comprising: a rear panel with inner and outer surfaces thereon including a lamp socket access opening therethrough having radially outwardly directed slots formed circumferentially therearound, a deflector ring on said rear panel outer surface formed circumferentially around said opening to shield said opening against water flow across the outer surface, a lamp socket including retention ears thereon at circumferential points therearound axially insertable through said ring and slots and rotatable with respect to said panel to secure said socket thereon, said ring having a catch thereon with a lead ramp and notch at a point circumferentially spaced from said retention slots, said socket having a flexible manually releasable lock arm thereon positioned in axial alignment with said ring when the socket is in place and having a surface thereon that rides circumferentially across said lead ramp upon rotation of said socket within said opening, said lock arm being spring biased into said notch to produce an audible signal to indicate positioning of said socket in a rotatably locked position on said panel, said lamp socket further including an integrally formed side terminal contact housing with a bulb opening, said housing further including a pair of spaced dividers formed on either side of the bulb opening, a pair of cantilever spring contacts located between said spaced dividers to define a right angle bulb contact surface for electrical connection to a bulb inserted in the socket, wires fixedly secured to said contacts extending from said housing at right angles to the bulb opening centerline, a ground terminal located within said contact housing having a first segment located in spaced parallelism with that of said cantilever spring contacts and a second segment arranged parallel to the centerline of the bulb opening and including a portion thereon electrically engageable with a bulb inserted therein to complete an energization circuit for the bulb, said housing including an access opening to said cantilever spring contacts and said ground terminal, and cover means closing said access opening and coacting means on said cover and said contact housing to fixedly secure them together for sealing the interior of said housing.

* * * * *